US009631888B2

(12) United States Patent
Young

(10) Patent No.: US 9,631,888 B2
(45) Date of Patent: Apr. 25, 2017

(54) QUICK CONNECT FOR PISTOL SUPPRESSOR

(71) Applicant: GEMINI TECHNOLOGIES, Eagle, ID (US)

(72) Inventor: Nolan Blake Young, Eagle, ID (US)

(73) Assignee: GEMINI TECHNOLOGIES, Eagle, ID (US)

( * ) Notice: Subject to any disclaimer, the term of this patent is extended or adjusted under 35 U.S.C. 154(b) by 71 days.

(21) Appl. No.: 14/877,000

(22) Filed: Oct. 7, 2015

(65) Prior Publication Data

US 2016/0102935 A1 Apr. 14, 2016

Related U.S. Application Data

(60) Provisional application No. 62/061,238, filed on Oct. 8, 2014.

(51) Int. Cl.
*F41A 21/32* (2006.01)

(52) U.S. Cl.
CPC ..... *F41A 21/325* (2013.01)

(58) Field of Classification Search
CPC ..... F41A 21/30; F41A 21/325; F41A 21/32; F41A 21/48
See application file for complete search history.

(56) References Cited

U.S. PATENT DOCUMENTS 4,510,843 A * 4/1985 Rabatin ..... F41A 21/325 89/14.4
5,685,102 A * 11/1997 Latka ..... F41A 21/325 42/76.01
7,588,122 B2 * 9/2009 Brittingham ..... F41A 21/325 181/223
8,272,306 B1 * 9/2012 Smith ..... F41A 21/30 181/223
8,291,805 B1 * 10/2012 Quilligan ..... F41A 21/325 285/305
8,387,299 B1 * 3/2013 Brittingham ..... F41A 21/30 42/90
8,424,441 B2 * 4/2013 Brittingham ..... F41A 21/26 181/223
8,997,621 B1 * 4/2015 Dater ..... F41A 21/325 89/14.3
9,175,919 B2 * 11/2015 Russell ..... F41A 21/325
2007/0095198 A1 * 5/2007 Dater ..... F41A 21/325 89/14.2

(Continued)

*Primary Examiner* — Benjamin P Lee
(74) *Attorney, Agent, or Firm* — Parsons Behle & Latimer

(57) ABSTRACT

A quick connect for a pistol suppressor includes a housing having a first end, a second end, and a central bore with an upper portion, a lower portion, and an internal shoulder separating the upper and lower portions. A piston is within the central bore of the housing. The piston includes a piston shoulder that creates an upper recess within a central bore of the piston. A ring connected to the second end of the piston is positioned between the housing and the piston and a spring is positioned around an exterior of the piston. A wave spring is positioned in the upper recess of the piston adjacent the piston shoulder and a washer is positioned within the upper recess of the piston. A cap with a central opening and an internal locking profile is connected to the piston with the wave spring biasing the washer towards the locking profile.

17 Claims, 8 Drawing Sheets

(56) References Cited

U.S. PATENT DOCUMENTS

| | | | | |
|---|---|---|---|---|
| 2009/0050403 | A1* | 2/2009 | Brittingham | F41A 21/325<br>181/223 |
| 2009/0193963 | A1* | 8/2009 | Poulsen | F41A 21/30<br>89/14.2 |
| 2010/0229712 | A1* | 9/2010 | Graham | F41A 21/34<br>89/14.2 |
| 2011/0036233 | A1* | 2/2011 | DeGroat | F41A 21/325<br>89/14.4 |

* cited by examiner

QUICK CONNECT FOR PISTOL SUPPRESSOR

RELATED APPLICATION DATA

The present application claims the benefit of priority under 35 U.S.C. §119 to U.S. Provisional Application No. 62/061,238, filed Oct. 8, 2014, entitled "Quick Connect for Pistol Suppressor," the disclosure of which is incorporated herein by reference in its entirety.

BACKGROUND

Field of the Disclosure

The embodiments described herein relate to a quick connect for a pistol suppressor.

Description of the Related Art

The barrel of semi-automatic pistols recoils a short distance upon discharging a round before the slide is unlocked. Typically, the barrel of the pistol actually tilts causing the lugs on the barrel and the slide to separate, thus unlocking the slide and allowing the gun to cycle the action after each discharge. The addition of a suppressor to the end of the barrel of such a pistol generally interferes with the tilting of the barrel to cycle the action. It has been known to use a recoiled booster, also referred to as a Nielsen device or a linear inertial decoupler ("LID"), in order to permit the use of a suppressor with such pistols. The LID temporarily decouples the suppressor from the barrel allowing the firearm to properly cycle the action after each discharge.

The use of a LID device generally does not permit the rapid attachment and detachment of a suppressor to the barrel of a pistol, which may limit applicability of using a suppressor with a semi-automatic handgun. A firearm suppressor is typically threaded onto a portion of the LID device, which is generally threaded onto a connector that connects the system to the end of the barrel. The threading of both the suppressor to the LID and the LID to a connector or adapter may prevent the use of a suppressor during military or tactical situations where speed and ease of attachment and detachment is desired.

Accordingly, there is a need to provide a connector that permits the rapid connection of a suppressor to a semi-automatic firearm. Other drawbacks and disadvantages of present semi-automatic handgun suppressor systems may also exist.

SUMMARY

The present disclosure is directed to a quick connect for a pistol suppressor. The quick connect is configured to integrate a LID, also referred to as a Neilson device, to permit the rapid connection of a suppressor to a semi-automatic pistol. The quick connect may address some of the problems and disadvantages discussed above.

One embodiment is a quick connect for a pistol suppressor comprising a housing with a first end and a second end, the housing having a central bore with an upper portion, a lower portion, and an internal shoulder separating the upper portion from the lower portion. The quick connect comprises a piston being positioned within the central bore of the housing, the piston having a first end, a second end, a central bore, and a piston shoulder, the piston shoulder creating an upper recess within the central bore of the piston. The quick connect includes a ring connected to the second end of the piston, the ring being positioned between the housing and the piston and a spring positioned around an exterior of the piston in the lower portion of the central bore of the housing, the spring being positioned between the ring and the internal shoulder of the housing. The quick connect comprises a wave spring positioned in the upper recess of the piston, the wave spring being positioned adjacent the piston shoulder and a washer positioned within the upper recess of the piston. The quick connect includes a cap having a central opening being positioned adjacent the first end of the housing, a portion of the cap being connected to the first end of the piston, the cap having an internal locking profile. The washer is positioned between the wave spring and the internal locking profile of the cap and the wave spring biases the washer towards the internal locking profile of the cap.

The piston of the quick connect may be movable relative to the housing from an initial position within the central bore of the housing, in the initial position the piston shoulder abuts against the internal shoulder of the housing. The ring may compress the spring against the internal shoulder of the housing upon movement of the piston from the initial position. The ring may be threaded onto the second end of the piston and a portion of the cap may be threaded onto the first end of the piston. The central opening of the cap may include a plurality of notches. The notches may provide access to the internal locking profile. The central opening of the cap may include four notches that provide access to the internal locking profile. The housing may include external threads.

One embodiment is a quick connect system for a pistol suppressor comprising a housing with a first end and a second end, the housing having a central bore with an upper portion, a lower portion, and an internal shoulder separating the upper portion from the lower portion. The system comprises a piston being positioned within the central bore of the housing, the piston having a first end, a second end, a central bore, and a piston shoulder, the piston shoulder creating an upper recess within the central bore of the piston. The system includes a ring connected to the second end of the piston, the ring being positioned between the housing and the piston and a spring positioned around an exterior of the piston in the lower portion of the central bore of the housing, the spring being positioned between the ring and the internal shoulder of the housing. The system includes a wave spring positioned in the upper recess of the piston, the wave spring being positioned adjacent the piston shoulder and a washer positioned within the upper recess of the piston. The system includes a cap having a central opening with a plurality of notches being positioned adjacent the first end of the housing, a portion of the cap being connecting to the first end of the piston, the cap having an internal locking profile with the notches configured to provide access to the internal locking profile. The system comprises a cylinder having a plurality of external lugs and a central bore with at least a portion of the central bore including threads, the cylinder configured to be inserted to the central opening of the cap with the plurality of external lugs configured to pass through the notches to selectively engage the internal locking profile. The washer of the system is positioned between the wave spring and the internal locking profile and the wave spring biases the washer towards the internal locking profile of the cap to selectively retain the lugs within the internal locking profile.

The lugs may be rotated to selectively engage the internal locking profile. The cylinder may be threaded onto a barrel of a piston. The piston may be movable relative to the housing from an initial position within the central bore due to the movement of the barrel, in the initial position the piston shoulder may abut against the internal shoulder of the housing. The ring may compress the spring against the internal shoulder of the housing upon movement of the piston from the initial position. The housing may include external threads and an external shoulder, wherein a suppressor may be connected to the housing via the external threads with an end of the suppressor abutted against the external shoulder. The movement of the piston relative to the housing may temporarily uncouple the suppressor from the barrel.

One embodiment is a quick connect system for a firearm suppressor comprising a housing having a first end, a second end, and an internal cavity, wherein an exterior portion of the housing is configured to be connected to a suppressor. The quick connect system comprises a cap operatively connected to the first end of the housing, the cap including a central opening having four notches and an internal locking profile. The quick connect system includes a cylinder having a central bore and four external lugs, a portion of the central bore being configured to be connected to a barrel of a firearm, wherein the four external lugs may pass through the four notches in the central opening of the cap to selectively engage the internal locking profile to selectively connect the cylinder to the cap.

The four external lugs of the quick connect system may be rotated to selectively engage the internal locking profile. The quick connect system may include a biasing mechanism to selectively retain the four external lugs within the internal locking profile. The quick connect system may include a piston positioned within the housing, wherein the cap may be threaded onto an end of the piston and wherein the piston may be configured to axially move within the cavity of the housing. The quick connect system may include a suppressor connected to the exterior of the housing and a barrel of a firearm connected to the cylinder, wherein the movement of the piston relative to the housing temporarily uncouples the suppressor from the barrel of the firearm.

Figure 1:
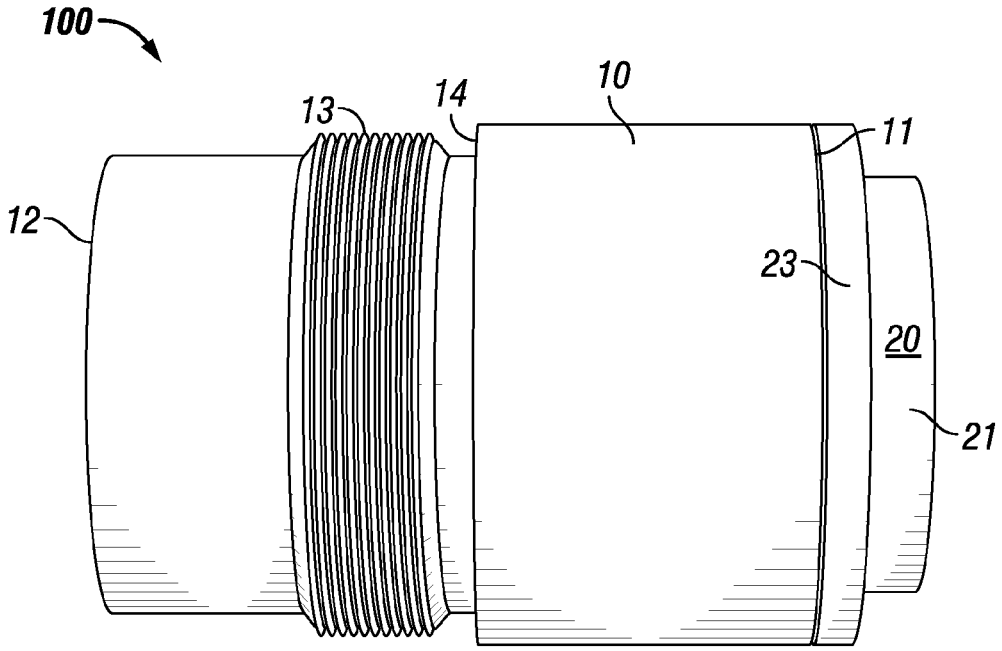
FIG. 1 shows one embodiment of a quick connect for a pistol suppressor.

While the disclosure is susceptible to various modifications and alternative forms, specific embodiments have been shown by way of example in the drawings and will be described in detail herein. However, it should be understood that the disclosure is not intended to be limited to the particular forms disclosed. Rather, the intention is to cover all modifications, equivalents and alternatives falling within the scope of the invention as defined by the appended claims.

DETAILED DESCRIPTION

FIG. 1 shows an embodiment of a quick connect 100 that does not require a separate LID or Nielsen device to decouple a suppressor from the barrel of a pistol. The quick connect 100 includes a housing 10 having a first end 11 and a second end 12. The housing 10 includes exterior threads 13 that permit the connection of a suppressor to the housing 10 as is discussed herein. The housing 10 includes an exterior shoulder 14 against which an end of a suppressor will abut as discussed herein. The quick connect 100 includes a cap 20 having an upper portion 21 and a flange 23. The flange 23 of the cap 20 is positioned adjacent to the first end 11 of the housing 10. The cap 20 may not be connected to the housing 10, but rather may be connected to a piston 50 (shown in FIG. 2) positioned within the housing 10 as detailed herein.

Figure 2:
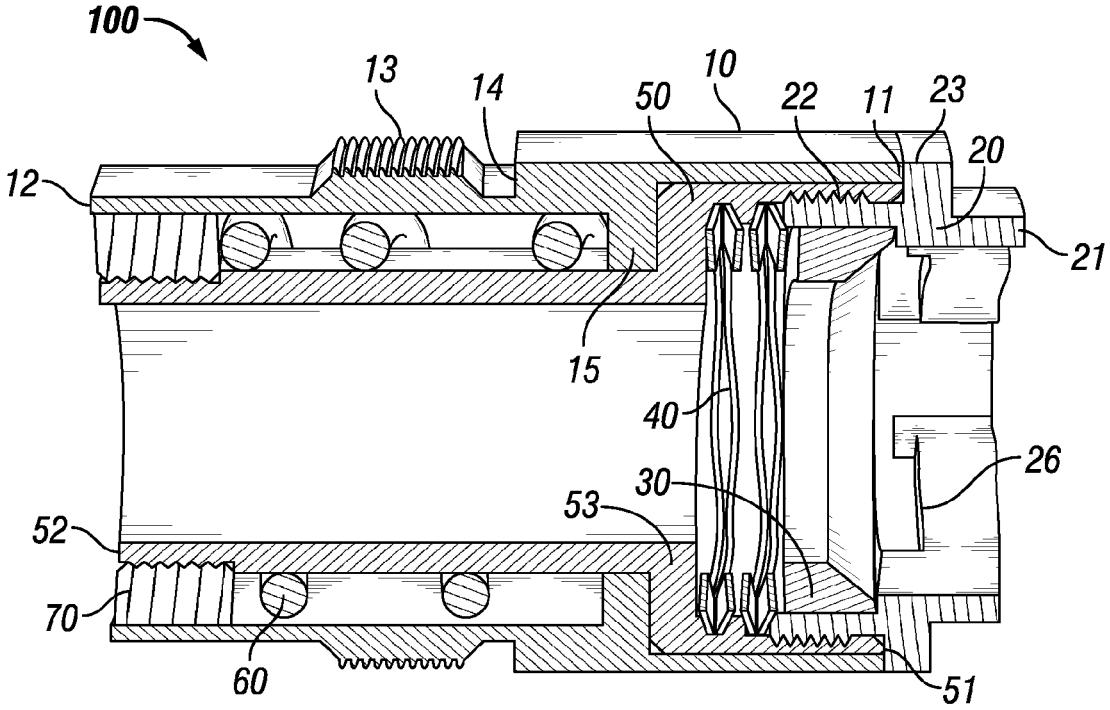
FIG. 2 shows a cross-section view of an embodiment of a quick connect for a pistol suppressor with a piston in an initial position.

FIG. 2 shows a cross-section view of an embodiment of a quick connect 100. The housing 10 includes a central bore (best shown in FIGS. 6 and 7) and an internal shoulder 15 within the central bore that separates the central bore into an upper portion 16 (shown in FIG. 6) and a lower portion 17 (shown in FIG. 7). The quick connect 100 includes a piston 50 having a first end 51, a second end 52, and a piston shoulder 53 between the first and second ends 51 and 52. The piston 50 includes a central bore 54 (shown in FIG. 8) and the piston shoulder 53 defines an upper recess 55 (shown in FIG. 9) within the central bore 54 of the piston 50. The piston 50 is positioned within the central bore of the housing 10 and extends from the first end 11 to the second end 12 of the housing 10 so that the piston 50 is positioned within both the upper and lower portions 16 and 17 of the central bore of the housing 10.

A spring 60 is positioned around the exterior of the piston 50 within the lower portion 17 of the central bore of the housing 10. A ring 70 is connected to the second end 52 of the piston 50. The ring 70 may be connected to the piston 50 by various mechanisms. For example, the ring 70 may be threaded onto the end of the as shown in FIG. 2. The ring 70 traps the spring 60 within an annular gap between the exterior of the piston 50 and the interior of the housing 10. The spring 60 is trapped in the annular space between the ring 70 and the internal shoulder 15 of the housing 10. As discussed herein, the piston 50 and the housing 10 are configured to move axially with respect to each other with the spring 60 biasing the ring 70 and the piston 50 in an initial position with respect to the housing 10 as shown in FIG. 2.

The quick connect 100 includes a biasing mechanism, such as a wave spring 40 positioned in the upper recess 55 of the piston 50. The wave spring 40 is positioned adjacent the piston shoulder 53 in the upper recess 55 of the central bore 54. A lower portion 22 of the cap 20 is connected to the first end 51 of the piston 50. Various mechanisms may be used to connect the cap 20 to the piston 50. For example, the lower portion 22 of the cap 20 may be threaded into first end 51 of the piston 50 as shown in FIG. 2. A washer 30 is positioned between the cap 20 and the wave spring 40 in the upper recess 55 of the central bore 54 of the piston 50. The wave spring 40 biases the washer 30 against an internal locking profile 26 of the cap 20, which may be used to selectively engage a connector within the internal locking profile 26 as would be appreciated by one of ordinary skill in the art having the benefit of this disclosure.

Figure 15:
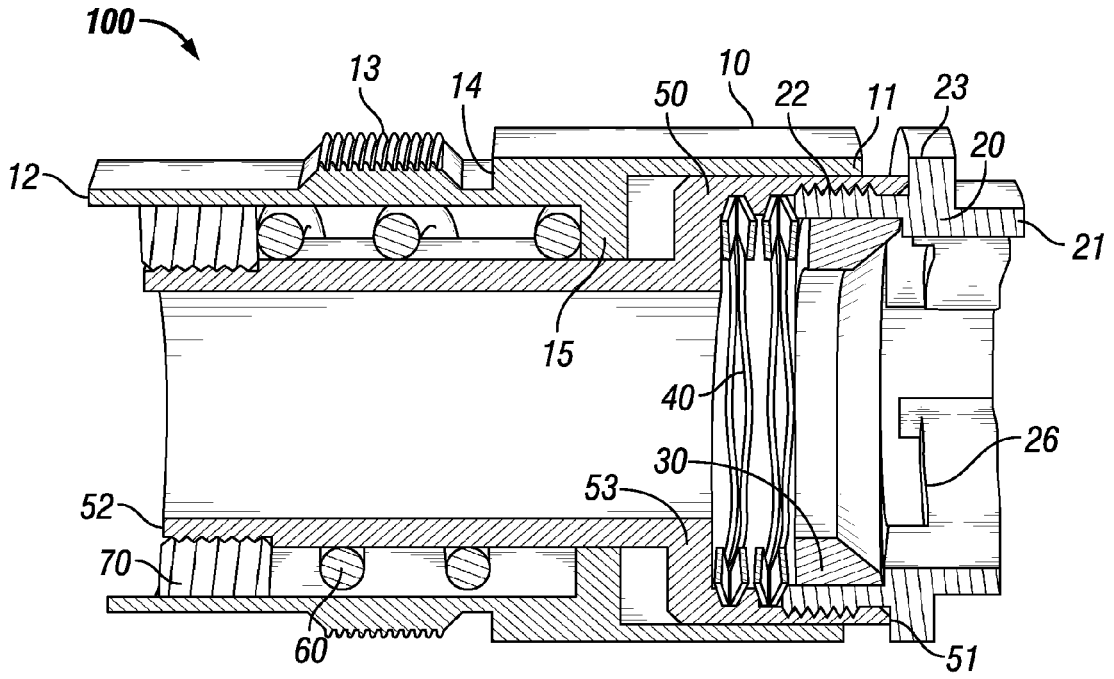
FIG. 15 shows a cross-section view of an embodiment of a quick connect for a pistol suppressor with a piston moved away from the initial position.

The piston 50 and housing 10 are adapted to move axially relative to each other. The movement of the housing 10 with respect from the piston 50 from the initial position (shown in FIG. 2) due to recoil during the discharge of a firearm effectively uncouples a suppressor, which will be connected to the housing via exterior threads 13, from the barrel of the firearm, which will be connected to the piston 50 via the internal locking profile 26 of the cap 20 as described herein. The recoil of the firearm causes the housing 10 to move away from the barrel of the firearm whereas the piston 50 is directly coupled to the barrel via the cap 20, as discussed herein. The movement of the housing 10 with respect to the piston 50 temporarily uncouples the housing 10, and thus the connected suppressor, from the piston 50, which is connected to the barrel of the firearm. As shown in FIG. 15, the uncoupling of the piston 50 and the housing 10 is further illustrated by a gap between the housing 10 and the cap 20, which is directly connected to the piston 50. Thus, the movement of the housing 10 moves the piston 50 away from its initial position (shown in FIG. 2) with respect to the housing as shown in FIG. 15. The movement of the housing 10 will compress the spring 60 between the ring 70 and the internal shoulder 15 of the housing 10. The compression of the spring 60 causes the piston 50 and housing 10 to move back to their initial positions after temporarily being uncoupled. The uncoupling of the piston 50 and housing 10 will not have an effect on the positional relationship between the wave spring 40, washer 30, and internal locking profile 26 of the cap 20 because the cap 20 is connected directly to the piston 50 and the wave spring 40 and washer 30 are trapped between the cap 20 and the piston shoulder 53.

Figure 3:
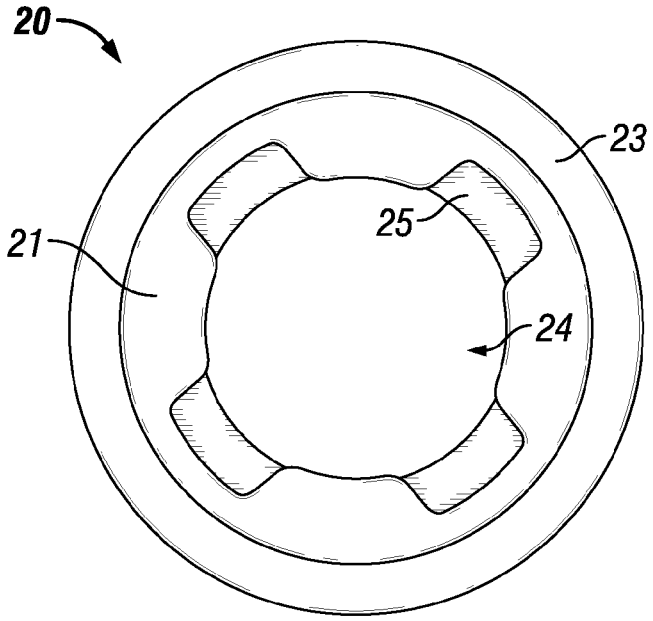
FIG. 3 shows a top view of one embodiment of a cap of a quick connect for a pistol suppressor.
Figure 4:
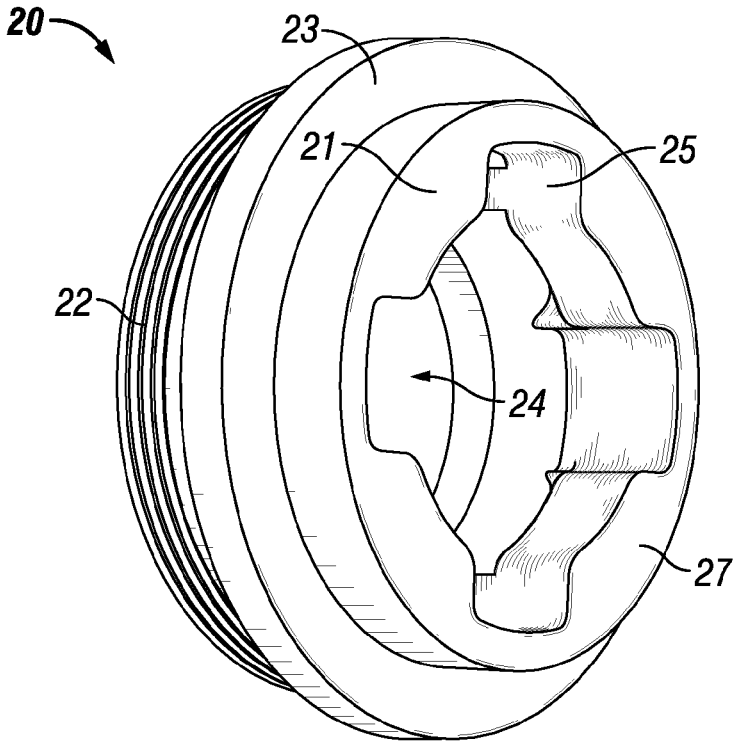
FIG. 4 shows an isometric view of one embodiment of a cap of a quick connect for a pistol suppressor.
Figure 5:
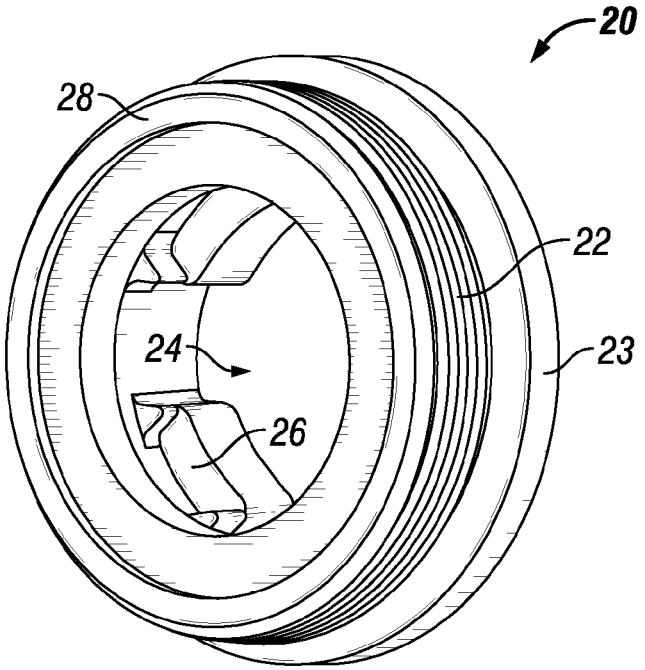
FIG. 5 shows an isometric view of one embodiment of a cap of a quick connect for a pistol suppressor.
Figure 13:
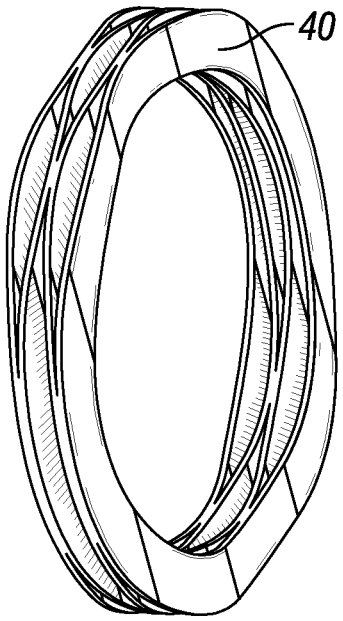
FIG. 13 shows one embodiment of a wave spring for a quick connect for a pistol suppressor.

FIG. 3 shows a top view, FIG. 4 shows an isometric top view, and FIG. 5 shows an isometric bottom view of an embodiment of a cap 20. The cap 20 has an upper portion 21, lower portion 22, and a flange 23 between the upper portion 21 and the lower portion 22. The lower portion 22 may include threads to permit the connection of the cap 20 to the piston 50. The cap 20 includes a central opening 24 that extends from a top surface 27 to a bottom surface 28. The central opening 24 includes a plurality of notches 25 that permit the passage of a locking structure of a connector through the central opening 24 to engage an internal locking profile 26. For example, locking lugs 151 on a cylinder 150 (shown in FIG. 10) may be aligned with the notches 25 to permit the insertion of the cylinder 150 into the central opening 24. The cylinder 150 may then be selectively locked or connected to the cap 20 by rotating the cylinder 150 so that the locking lugs 151 engage the internal locking profile 26. As discussed above, when the cap 20 is connected to the piston 50, the washer 30 that is biased by the wave spring 40 may selectively retain the locking lugs 151 within the internal locking profile 26. FIG. 13 shows an embodiment of a wave spring 40 that may be used with the quick connect 100. To disconnect the cylinder 150, a user may depress the washer 30 and wave spring 40 to disengage the locking lugs 151 from the internal locking profile 26. Then, a user may rotate the cylinder 150 until the locking lugs 151 align with the notches 25 to permit the removal of the cylinder 150 from the central opening 24. As discussed herein, the cylinder 150 may be threaded onto a barrel 300 of a firearm (shown in FIG. 14) and then used to selectively connect the quick connect 100 to the firearm. In this way, the quick connect 100 and cylinder 100 permit the rapid attachment and detachment of an accessory, such as a suppressor 200 (shown in FIG. 14) to the barrel of a firearm. Various locking structures and profiles may be used to selectively secure a barrel 300 to the quick connect 100 as would be appreciated by one of ordinary skill in the art having the benefit of this disclosure. As may also be appreciated from the disclosure herein, the cylinder 150 and an embodiment of the quick connect 100 may be used to connect a suppressor to firearms other than semi-automatic pistols.

Figure 6:
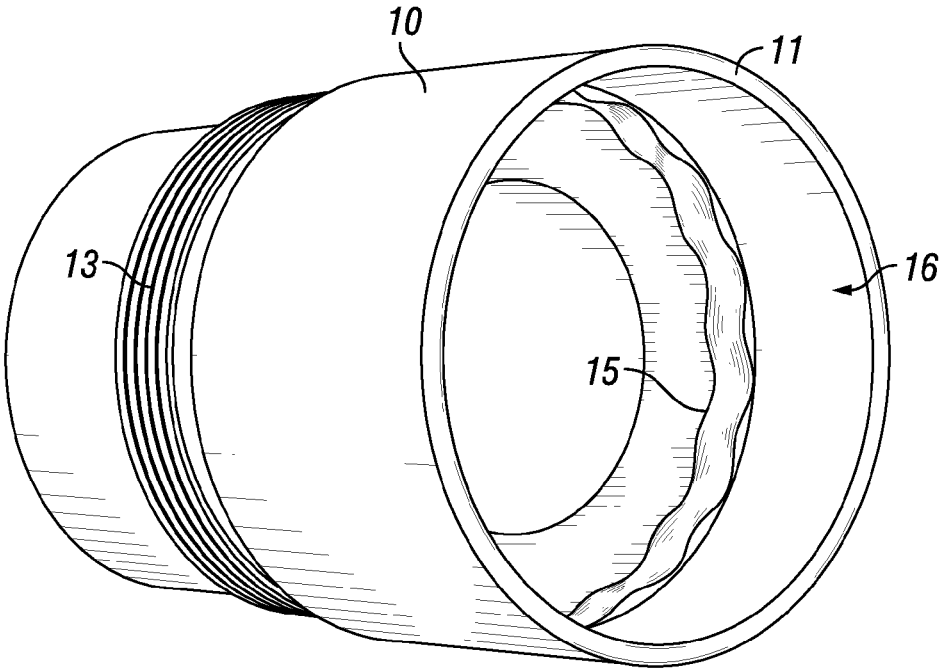
FIG. 6 shows an isometric view of one embodiment of a housing for a quick connect for a pistol suppressor.
Figure 7:
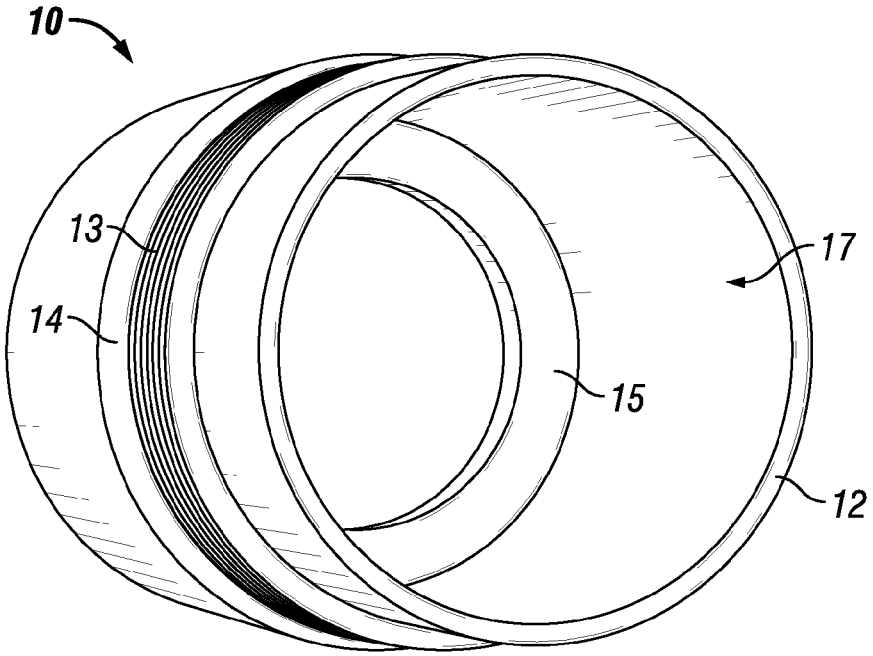
FIG. 7 shows an isometric view of one embodiment of a housing for a quick connect for a pistol suppressor.

FIG. 6 shows an isometric top view and FIG. 7 shows an isometric bottom view of a housing 10 that may be used in connection with the quick connect 100. The housing 10 includes a first end 11, a second end 12, and exterior threads 13 that permit the attachment and detachment of a suppressor 200 to the housing 10. The housing 10 includes an exterior shoulder 14 against which an end of a suppressor will abut. The housing 10 includes an upper portion 16 of a central bore that is separated from the lower portion 17 (shown in FIG. 7) of the central bore by an internal shoulder 15.

Figure 8:
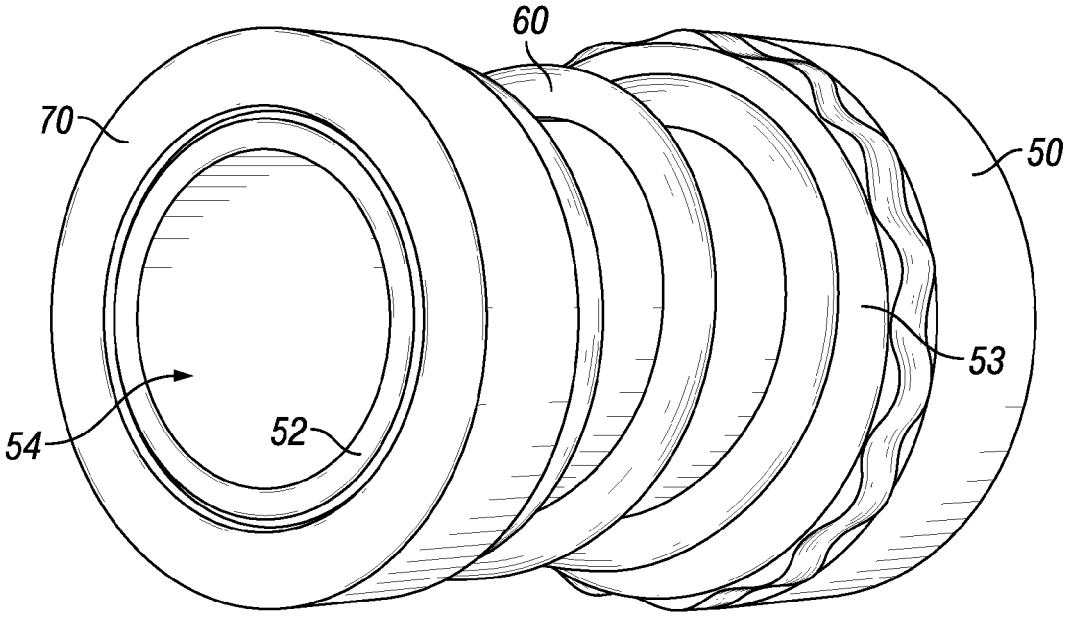
FIG. 8 shows one embodiment of a piston, spring, and ring for a quick connect for a pistol suppressor.
Figure 9:
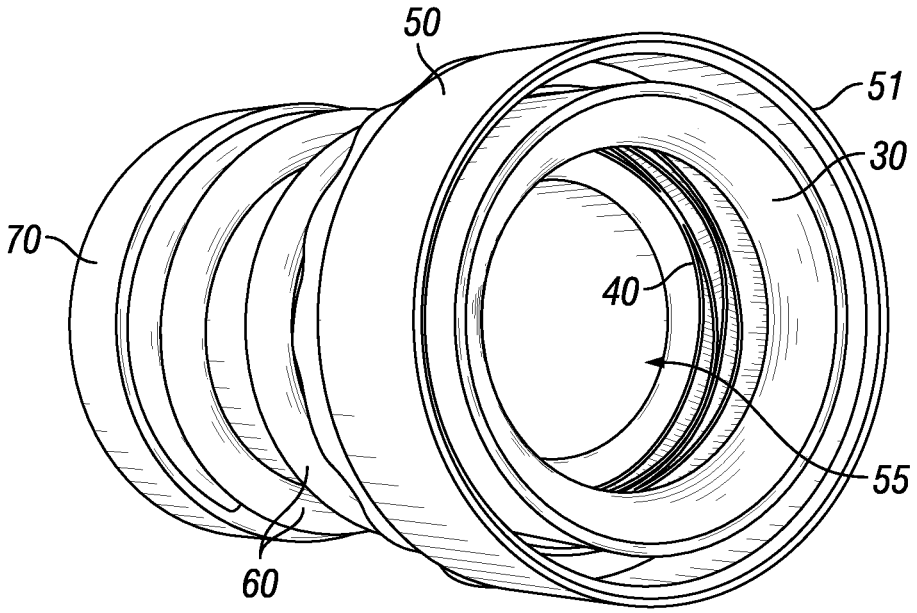
FIG. 9 shows one embodiment of a piston, spring, and ring for a quick connect for a pistol suppressor.

FIG. 8 shows an isometric view of an embodiment of a piston 50 that may be used within the housing 10 of a quick connect 100. A ring 70 is connected to the second end 52 of the piston 50. A spring 60 is positioned around the exterior of the piston 50 between a piston shoulder 53 and the ring 70. The piston includes a central bore 54. FIG. 9 shows an isometric view of the first end 51 of the piston 50 with a wave spring 40 and a washer 30 positioned within an upper recess 55 of the central bore 54 of the piston 50. The upper recess 55 is created by the piston shoulder 53. When installed within the housing 10 of the quick connect 100, the spring 60 is trapped between the ring 70 and the internal shoulder 15 of the housing 10. The spring 60 biases the piston 50 and housing 10 to their initial relative positions as shown in FIG. 2.

Figure 10:
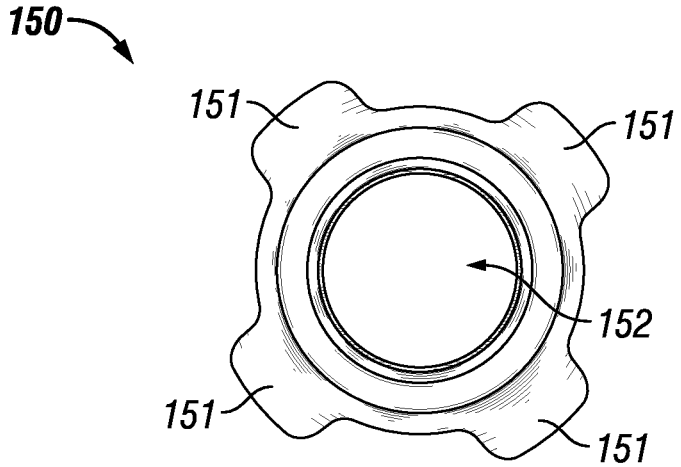
FIG. 10 shows one embodiment of a cylinder with locking lugs for use with a quick connect for a pistol suppressor.
Figure 11:
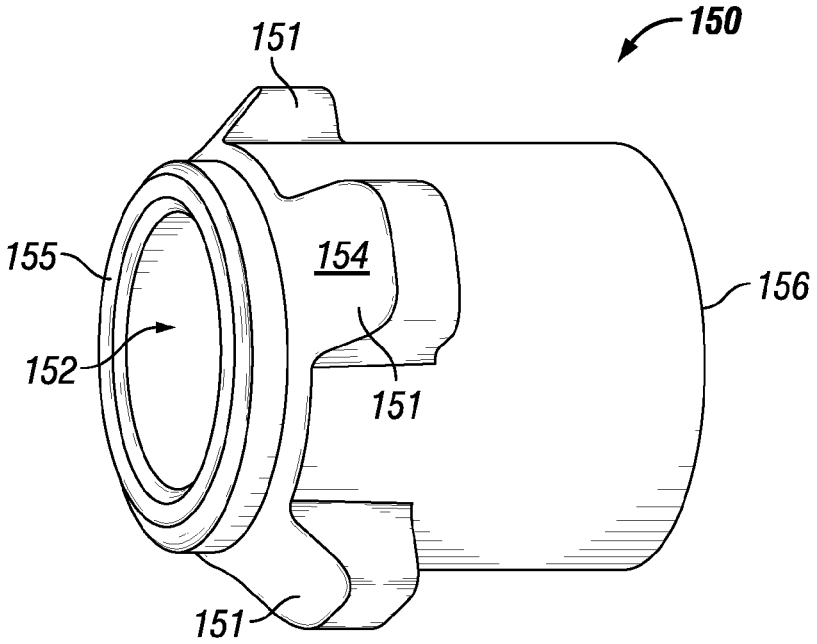
FIG. 11 shows one embodiment of a cylinder with locking lugs for use with a quick connect for a pistol suppressor.

FIG. 10 shows an embodiment of a cylinder 150 that may be threaded onto a barrel 300 of a semi-automatic pistol to permit the rapid attachment and detachment of a suppressor 200 via the quick connect 100. The cylinder 150 includes a plurality of locking lugs 151 and a central opening 152. FIG. 11 shows an isometric view of the cylinder 150. The central opening 152 of the cylinder 150 extends from a first end 155 to a second end 156. The plurality of locking lugs 151 are positioned at the first end 155 of the cylinder 150. The plurality of locking lugs 151 are configured to engage an internal locking profile 26 of the quick connect 100. A surface 154 of the locking lugs 151 may be tapered to aid in the insertion of the locking lugs 151 into the internal locking profile 26. The use of four locking lugs 151 equally spaced around the cylinder 150 may require minimal rotation of the cylinder 150 to engage the internal locking profile 26. Further, the use of four locking lugs 151 on the cylinder may provide better balanced contact surfaces between the locking lugs 151 and the internal locking profile 26.

Figure 12:
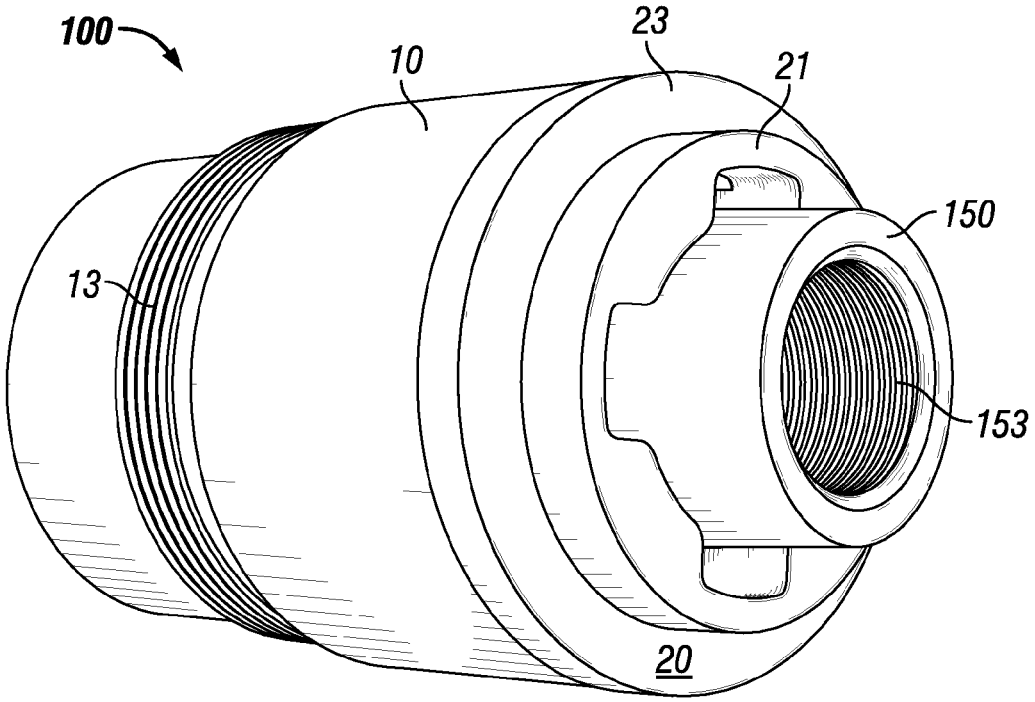
FIG. 12 shows one embodiment of a quick connect and cylinder with locking lugs for a pistol suppressor.
Figure 14:
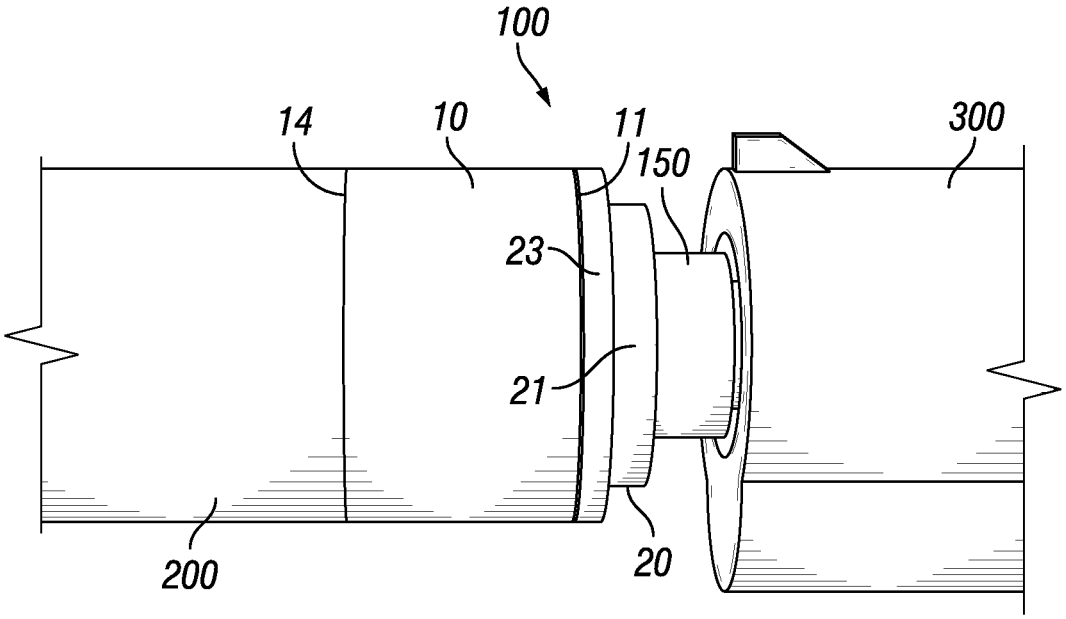
FIG. 14 shows a suppressor connected to a pistol via one embodiment of a quick connect and cylinder with locking lugs.

FIG. 12 shows the cylinder 150 inserted and selectively locked into the quick connect 100. The central opening 152 in the cylinder 150 includes threads 153 so that the cylinder 150 may be threaded onto a barrel 300 of a pistol. The cylinder 150 and quick connect 100 provide for the rapid attachment and detachment of a suppressor 200 to the barrel 300 of a firearm. For example, the cylinder 150 may be threaded onto the barrel 300 of a pistol and the pistol may then be holstered. A suppressor 200 may be threaded onto the quick connect 100 and then stored in a pocket. The cylinder 150 and the cap 20 of the quick connect 100 permit the rapid attachment of the suppressor 200 to the barrel 300 by the simple insertion of the locking lugs 151 of the cylinder 150 into the central opening 24 of the cap 20 followed by less than a quarter rotation of the connected quick connect 100 and suppressor 200. Likewise, the suppressor 200 may be rapidly detached from the barrel 300 by simply depressing the wave spring 40 and rotating the suppressor 200 less than a quarter of rotation in the opposite direction. FIG. 14 shows a suppressor 200 connected to a barrel 300 via the quick connect 100 and the cylinder 150.

Although this disclosure has been described in terms of certain preferred embodiments, other embodiments that are apparent to those of ordinary skill in the art, including embodiments that do not provide all of the features and advantages set forth herein, are also within the scope of this disclosure. Accordingly, the scope of the present disclosure is defined only by reference to the appended claims and equivalents thereof.

What is claimed is:

1. A quick connect for a pistol suppressor comprising:

a housing with a first end and a second end, the housing having a central bore with an upper portion, a lower portion, and an internal shoulder separating the upper portion from the lower portion;

a piston being positioned within the central bore of the housing, the piston having a first end, a second end, a central bore, and a piston shoulder, the piston shoulder creating an upper recess within the central bore of the piston;

a ring connected to the second end of the piston, the ring being positioned between the housing and the piston;

a spring positioned around an exterior of the piston in the lower portion of the central bore of the housing, the spring being positioned between the ring and the internal shoulder of the housing;

a wave spring positioned in the upper recess of the piston, the wave spring being positioned adjacent the piston shoulder;

a washer positioned within the upper recess of the piston; and a cap having a central opening being positioned adjacent the first end of the housing, a portion of the cap being connected to the first end of the piston, the cap having an internal locking profile;

wherein the washer is positioned between the wave spring and the internal locking profile of the cap and the wave spring biases the washer towards the internal locking profile of the cap.

2. The quick connect of claim 1, wherein the piston is movable relative to the housing from an initial position within the central bore of the housing, in the initial position the piston shoulder abuts against the internal shoulder of the housing.

3. The quick connect of claim 2, wherein the ring compresses the spring against the internal shoulder of the housing upon movement of the piston from the initial position.

4. The quick connect of claim 3, wherein the ring is threaded onto the second end of the piston and wherein the portion of the cap is threaded onto the first end of the piston.

5. The quick connect of claim 4, wherein the central opening of the cap further comprises a plurality of notches.

6. The quick connect of claim 5, wherein the notches provide access to the internal locking profile.

7. The quick connect of claim 5, wherein the central opening of the cap further comprises four notches that provide access to the internal locking profile.

8. The quick connect of claim 5, the housing further comprising external threads.

9. A quick connect system for a pistol suppressor comprising:

a housing with a first end and a second end, the housing having a central bore with an upper portion, a lower portion, and an internal shoulder separating the upper portion from the lower portion;

a piston being positioned within the central bore of the housing, the piston having a first end, a second end, a central bore, and a piston shoulder, the piston shoulder creating an upper recess within the central bore of the piston;

a ring connected to the second end of the piston, the ring being positioned between the housing and the piston;

a spring positioned around an exterior of the piston in the lower portion of the central bore of the housing, the spring being positioned between the ring and the internal shoulder of the housing;

a wave spring positioned in the upper recess of the piston, the wave spring being positioned adjacent the piston shoulder;

a washer positioned within the upper recess of the piston; and a cap having a central opening with a plurality of notches being positioned adjacent the first end of the housing, a portion of the cap being connected to the first end of the piston, the cap having an internal locking profile with the notches configured to provide access to the internal locking profile;

a cylinder having a plurality of external lugs and a central bore with at least a portion of the central bore including threads, the cylinder configured to be inserted into the central opening of the cap with the plurality of external lugs configured to pass through the notches to selectively engage the internal locking profile;

wherein the washer is positioned between the wave spring and the internal locking profile and the wave spring biases the washer towards the internal locking profile of the cap to selectively retain the lugs within the internal locking profile.

10. The quick connect system of claim 9, wherein the lugs are rotated to selectively engage the internal locking profile.

11. The quick connect system of claim 10, wherein the cylinder may be threaded onto a barrel of a pistol.

12. The quick connect system of claim 11, wherein the piston is movable relative to the housing from an initial position within the central bore of the housing due to the movement of the barrel, in the initial position the piston shoulder abuts against the internal shoulder of the housing.

13. The quick connect system of claim 12, wherein the ring compresses the spring against the internal shoulder of the housing upon movement of the piston from the initial position.

14. The quick connect system of claim 13, the housing further comprising external threads and an external shoulder, wherein a suppressor may be connected to the housing via the external threads with an end of the suppressor abutted against the external shoulder.

15. The quick connect system of claim 14, wherein the movement of the piston relative to the housing temporarily uncouples the suppressor from the barrel.

16. A quick connect system for a firearm suppressor comprising:

a housing having a first end, a second end, and an internal cavity, wherein an exterior portion of the housing is configured to be connected to a suppressor;

a cap, the cap including a central opening having four notches and an internal locking profile;

a cylinder having a central bore and four external lugs, a portion of the central bore being configured to be connected to a barrel of a firearm;

wherein the four external lugs may pass through the four notches in the central opening of the cap to selectively engage the internal locking profile to selectively connect the cylinder to the cap and wherein the four external lugs are rotated to selectively engage the internal locking profile;

a biasing mechanism to selectively retain the four external lugs within the internal locking profile; and a piston positioned within the housing, wherein the cap is threaded onto an end of the piston and wherein the piston is configured to axially move within the cavity of the housing.

17. The system of claim 16, further comprising a suppressor connected to the exterior of the housing and a barrel of a firearm connected to the cylinder, wherein the movement of the piston relative to the housing temporarily uncouples the suppressor from the barrel of the firearm.

* * * * *